US005847627A

United States Patent [19]

Radzikowski et al.

[11] Patent Number: 5,847,627

[45] Date of Patent: Dec. 8, 1998

[54] BANDSTOP FILTER COUPLING TUNER

[75] Inventors: Piotr O. Radzikowski, Chicago; Craig R. Clermont, Round Lake Beach, both of Ill.

[73] Assignee: Illinois Superconductor Corporation, Mt. Prospect, Ill.

[21] Appl. No.: 706,637

[22] Filed: Sep. 18, 1996

[51] Int. Cl.[6] ..... H01P 1/201

[52] U.S. Cl. ..... 333/202; 333/219; 333/230; 333/99.005; 505/210; 505/700; 505/866

[58] Field of Search ..... 333/203, 219, 333/219.1, 230, 202, 202 DR, 202 HC; 505/210, 700, 866

[56] References Cited

U.S. PATENT DOCUMENTS

| | | | |
|---|---|---|---|
| 3,098,206 | 7/1963 | Moulton | 333/202 |
| 3,896,400 | 7/1975 | Hyde | 333/21 R |
| 4,019,161 | 4/1977 | Kimura et al. | 333/234 |
| 4,028,652 | 6/1977 | Wakino et la. | 333/202 |
| 4,060,779 | 11/1977 | Atia et al. | 333/212 |
| 4,135,133 | 1/1979 | Mok | 333/209 |
| 4,142,164 | 2/1979 | Nishikawa et al. | 333/219.1 |
| 4,143,344 | 3/1979 | Nishikawa et al. | 333/202 |
| 4,489,293 | 12/1984 | Fiedziuszko | 333/202 |
| 4,540,955 | 9/1985 | Fiedziuszko | 331/107 DP |
| 4,551,694 | 11/1985 | Biehl et al. | 333/24 C |
| 4,652,843 | 3/1987 | Tang et al. | 333/212 |
| 4,652,844 | 3/1987 | Brambilla | 333/212 |
| 4,675,630 | 6/1987 | Tang et al. | 333/208 |
| 4,692,723 | 9/1987 | Fiedziuszko et al. | 333/202 |
| 4,721,933 | 1/1988 | Schwartz et al. | 333/212 |
| 5,083,102 | 1/1992 | Zaki | 333/212 |
| 5,184,098 | 2/1993 | Kich et al. | 333/208 |
| 5,191,304 | 3/1993 | Jachowski | 333/245 X |
| 5,200,721 | 4/1993 | Mansour | 333/202 |
| 5,268,659 | 12/1993 | Zaki et al. | 333/209 |
| 5,285,178 | 2/1994 | Ahlberg | 333/224 |
| 5,373,270 | 12/1994 | Blair et al. | 333/235 X |
| 5,391,543 | 2/1995 | Higaki et al. | 505/210 |
| 5,495,216 | 2/1996 | Jachowski | 333/208 |
| 5,608,363 | 3/1997 | Cameron et al. | 333/230 X |

FOREIGN PATENT DOCUMENTS

| | | | |
|---|---|---|---|
| 209878 | 1/1987 | European Pat. Off. | 333/202 DR |
| 0 713 238 A1 | 5/1996 | European Pat. Off. . | |
| 284101 | 11/1989 | Japan | 333/202 DR |
| 3254501 | 11/1991 | Japan | 333/202 DR |

OTHER PUBLICATIONS

PCT International Search Report of International Application No. PCT/US97/13890.

Patent Abstract for the European Patent Office of Japanese Publication No. 56076605, Publication Date 24, Jun. 1981.

*Primary Examiner*—Benny Lee

*Attorney, Agent, or Firm*—Marshall, O'Toole, Gerstein, Murray & Borun

[57] ABSTRACT

A resonant structure and filter include a resonant element mounted to the cover of a housing. A transmission line passes through the cover and is connected to a coupling loop. The coupling loop is located adjacent the resonator and is connected to ground. A coupling tuner is attached to the housing and includes a post which is movably attached to the housing. The tuner extends between the coupling loop and the resonator, and may be adjusted to change the electromagnetic coupling.

19 Claims, 4 Drawing Sheets

BANDSTOP FILTER COUPLING TUNER

FIELD OF THE INVENTION

The present invention relates generally to bandstop electromagnetic filters, and more particularly to devices for adjusting the coupling between the filter's transmission line and each electromagnetic resonator in the filter.

BACKGROUND OF THE INVENTION

Bandstop or "notch" filters generally have a transmission line between the filter input connection and the filter output connection. Several coupling loops are provided such that one end of each coupling loop is connected to the transmission line and the other end of each coupling loop is connected to ground. Each coupling loop is located adjacent a resonant element or resonator that dissipates signals at or near the resonant frequency of the resonator. The resonators and coupling loops are generally located in cavities formed in a metal housing which generally serves as the ground connection.

In order to vary the bandwidth of dissipated signals about the resonant frequency, the coupling between the coupling loop and the resonator may be adjusted or "tuned." Adjusting the coupling may be accomplished in a variety of ways, often simply by changing the position of the coupling loop with respect to the resonant structure. Moving the coupling loop inside of a closed housing, however, may be difficult, especially if the resonators are constructed entirely or in part of high-temperature superconductor materials. When superconductors are used, the filters must be cooled and are often stored in sealed cryostats or liquid nitrogen baths, making positioning of a coupling loop inside a resonant cavity extremely difficult.

In the present assignee's co-pending U.S. patent application Ser. No. 08/556,371, adjusting of coupling is accomplished by use of an adjustable capacitor connected between the coupling loop and ground. The capacitor is adjusted by moving plates inside the capacitor via an adjustment screw located outside of the filter housing. Use of such a capacitor, however, may have drawbacks if the capacitor is not designed to withstand cryogenic conditions over long periods of time. Under such conditions, the materials in the capacitors may fail or become displaced leading to an undesirable change in the coupling tuning.

In the present assignee's co-pending U.S. application Ser. No. 08/643,517, coupling is adjusted by use of an extendible post located between the coupling loop and its ground connection on the filter housing. By extending the post, the tilt of the coupling loop is changed, thereby adjusting the position of the loop with respect to its respective resonator. Such an adjustment mechanism may be unstable and/or require relatively complex components. Moreover, in adjusting the tilt of the coupling loop, the distance between the coupling loop and resonator might also be undesirably changed.

SUMMARY OF THE INVENTION

In accordance with one aspect of the present invention, a resonant structure has a housing defining a cavity with a resonant element located in the cavity. A coupling loop is connected to a signal source. The coupling loop is adjacent the resonant element, and a coupling tuner extends into the cavity. The coupling tuner includes means for adjusting the extent to which the tuner extends into the cavity.

The housing may include a base and a cover. The resonant element and coupling loop may be fixed to the cover, and the coupling tuner is attached to the base. The base may include four side walls and a top wall where the side walls are generally perpendicular to the cover. The top wall is generally parallel to the cover, and the coupling tuner is attached to the top wall. The coupling tuner may be adjusted from outside the cavity, adjacent the top wall. A resonance tuner may also be attached to the top wall and adjusted from outside the cavity. The coupling tuner may be a threaded rod passing through a wall of the housing and into the cavity.

The coupling tuner may extend between the resonant element and the coupling loop, and the coupling tuner may include means for adjusting the extent to which the coupling tuner extends between the resonant element and the coupling loop.

The coupling loop may include a first arm, a curved portion, and a second arm. A first plane is perpendicular to the curved portion and includes the first arm, and a second plane is perpendicular to the curved portion and includes the second arm. The coupling tuner may extend between the first plane and the second plane in the area of the curved portion. The resonant element has a major curve located in a third plane, and the coupling tuner may extend generally parallel to the third plane. The coupling loop may have a first end connected to a transmission line and a second end connected to ground.

In accordance with another aspect of the present invention, an electromagnetic filter may include a housing having a plurality of cavities and a plurality of resonant elements, where each resonant element is located in a respective cavity. The filter has a plurality of coupling loops with each coupling loop having a first end connected to a transmission line, and a second end connected to electrical ground where each coupling loop is adjacent a corresponding resonator. The filter has a plurality of coupling tuners, where each coupling tuner extends into a corresponding cavity. Each coupling tuner includes respective means for adjusting the extent to which the tuner extends into its respective cavity.

Other features and advantages are inherent in the resonant structure claimed and disclosed, or will become apparent to those skilled in the art from the following detailed description in conjunction with the accompanying drawings.

BRIEF DESCRIPTION OF THE DRAWINGS

5

DETAILED DESCRIPTION OF THE PREFERRED EMBODIMENT

Figure 1:
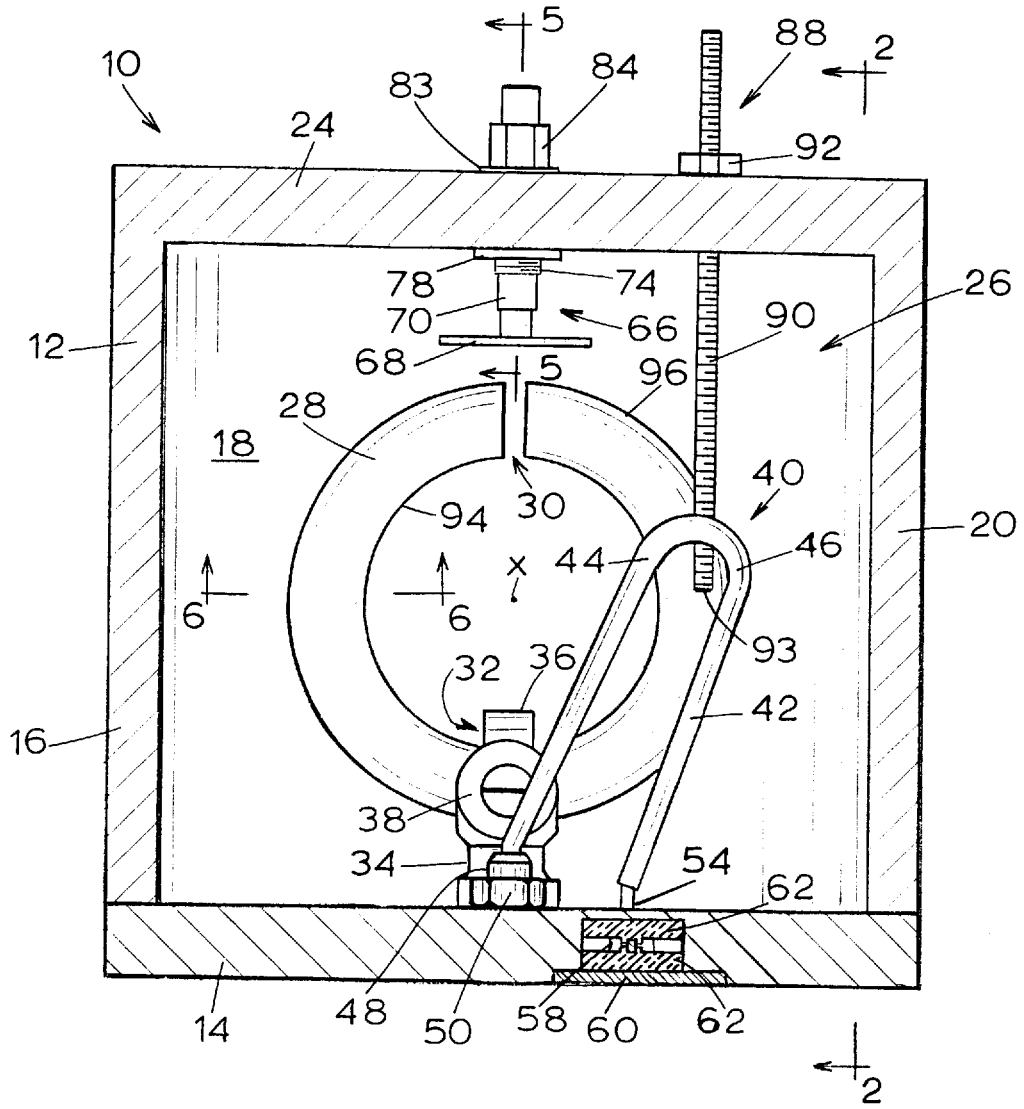
FIG. 1 is a sectional view of a resonant structure of the present invention taken along the line 1—1 of FIG. 2.
Figure 2:
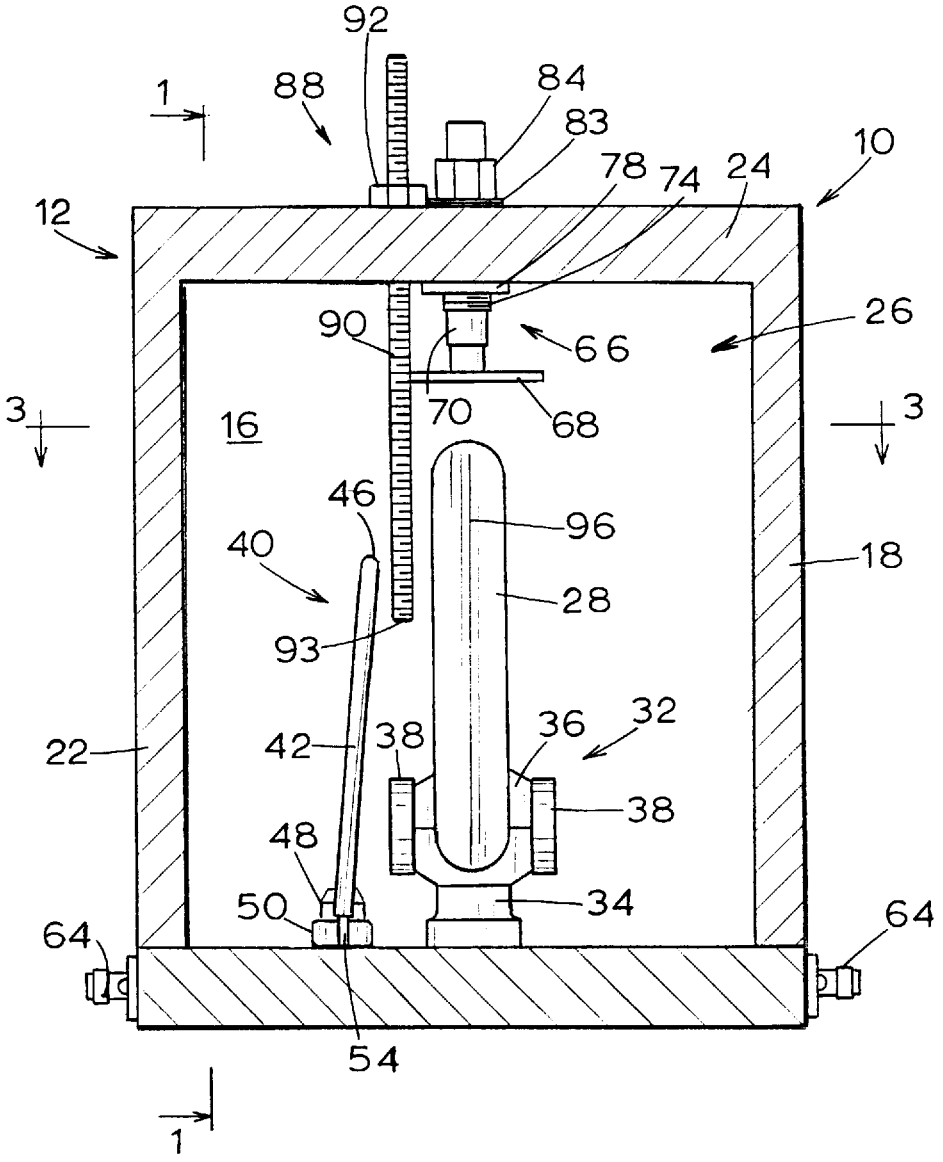
FIG. 2 is a sectional view of a resonant structure of the present invention taken along the line 2—2 of FIG. 1.
Figure 7:
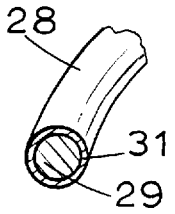
FIG. 7 is a sectional view of a resonant element taken along the line 6—6 of FIG. 1.
Figure 3:
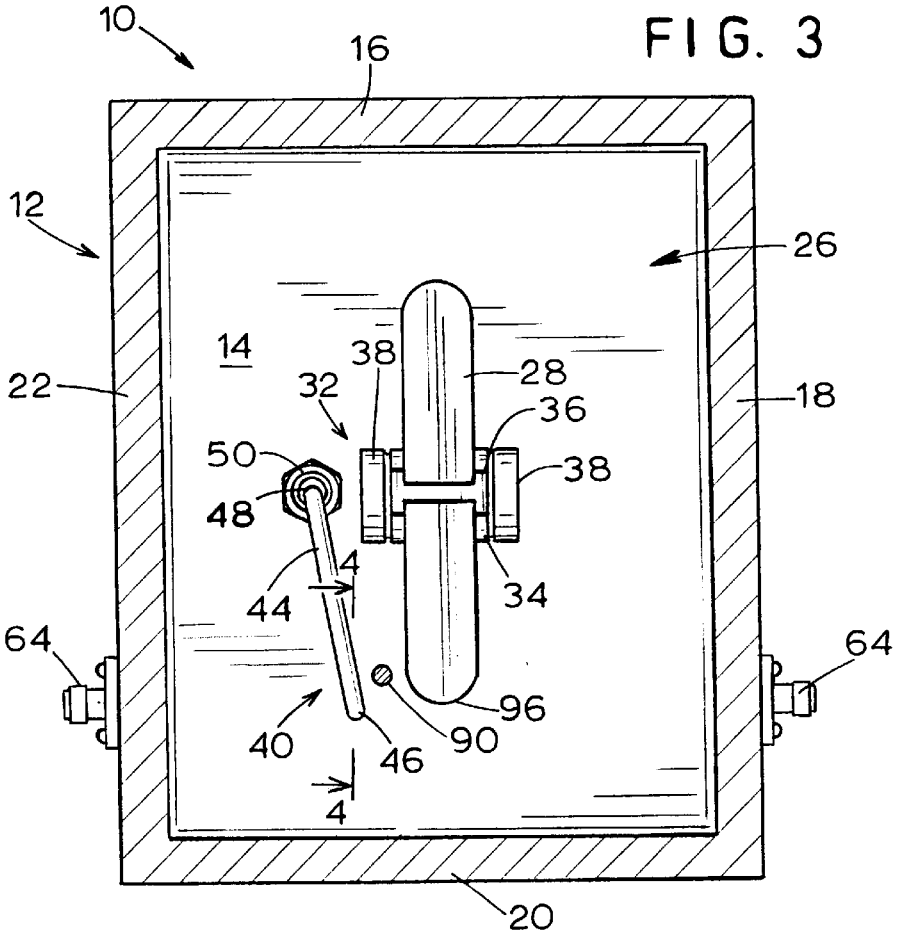
FIG. 3 is a sectional view of a resonant structure of the present invention taken along the line 3—3 of FIG. 2.

Referring initially to FIGS. 1–3, a resonant structure indicated generally at 10 includes a housing having a base 12 and a cover 14 (FIGS. 2 and 3). The base 12 includes side walls 16, 18, 20 (FIGS. 1 and 3), and 22 (FIGS. 2 and 3), and a top wall 24 (FIGS. 1 and 2). The base 12 and cover 14 are held together by bolts (not depicted) and define a cavity indicated generally at 26. Located inside the cavity 26 is a resonant element 28, which is a split ring resonator having a gap indicated generally at 30 (FIG. 1). The resonant element 28 has a major curve about an axis X (FIG. 1), and is symmetrical about X, except for the gap 30. As seen in FIG. 7, the resonant element 28 has a circular or curved cross section and consists of a substrate 29 coated with a layer 31 of high-temperature superconductor material. The resonant element 28 is attached to the cover 14 by a resonator mounting structure indicated generally at 32, which includes a base 34, a cap 36, and two circular rings 38 that hold the base 34 to the cap 36. An epoxy may be applied to the resonant element 28 and resonator mounting structure 32 to prohibit any movement of the resonant element 28 with respect to the mounting structure 32.

Also mounted to the cover 14 is a coupling loop indicated generally at 40. The coupling loop 40 has a first arm 42 and a second arm 44 connected by a curved portion 46 (FIG. 1). Attached at the end of the second arm 44 is a threaded peg 48, which is inserted into a threaded opening (not depicted) in the cover 14. The peg 48 is rotated into the opening in the cover 14 to place the coupling loop at the proper height with respect to the cover 14 and resonant element 28. A locking nut 50 tightens about the peg 48 in order to secure the peg 48 to the cover 14, and thereby securely electrically connect the coupling loop 40 to ground.

Figure 4:
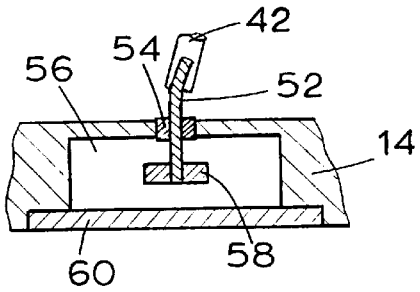
FIG. 4 is a sectional view of a resonant structure of the present invention taken along the line 4—4 in FIG. 3.

The first arm 42 of the coupling loop 40 is soldered at its end to a pin 54. As seen in FIG. 4, the pin 52 attached to the first arm 42 passes through a spacer 54 (FIGS. 1 and 2) and into a recess 56 within the cover 14, where it is soldered to a transmission line 58. The recess 56 is closed by a lid 60, which also holds spacers 62 (FIG. 1) in place to electrically insulate the transmission line 58 from the cover 14. The transmission line 58 is connected to input/output connections 64 (FIGS. 2 and 3), which are used to connect the resonant structure 10 with devices (not depicted) for inputing signals or for receiving output signals.

Figure 5:
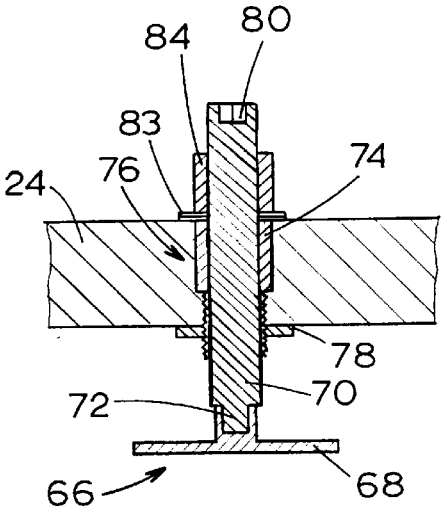
FIG. 5 is a sectional view of a resonance tuner taken along the line 5—5 of FIG. 1.

A resonance tuner, indicated generally at 66 (FIG. 1), is located adjacent the gap 30 of the resonant element 28. As best seen in FIG. 5, the resonance tuner 66 has a tuning disk 68 connected to a tuner body 70 by threads on the interior of the tuning disk 68 and on the exterior of a tip 72 of the tuner body 70. A belleville or locking -type washer (not depicted) may be placed between the tuning disk 68 and the tuner body 70. A tuner bushing 74 is inserted into a passageway, indicated generally at 76, in the top wall 24 of the base 12 (FIGS. 1–3). The tuner bushing 74 is held in place by tuner bushing locknut 78. The tuner body 70 is inserted into the tuner bushing 74, which engage each other by threads on the exterior of the tuner body 70 and on the interior of the tuner bushing 74. The tuner body 70 is rotated with respect to the tuner bushing 74 by use of a hexagonal recess 80.

When rotated by the hexagonal recess 80, the tuner body 70 rotates, thereby moving the tuning disk 68 closer to or farther from the gap 30 of the resonant element 28. The tuning disk 68 is made of a conductor, such as brass coated with silver, and therefore impacts the magnetic and electric fields around the resonant element 28 (FIGS. 1 and 2). The resonant element 28 and cavity 26 are thereby tuned to resonate at the desired frequency. Once the tuning disk 68 has been properly positioned, the tuner body 70 is locked into place using two washers 83 and a lock nut 84.

As best seen in FIGS. 1 and 2, a coupling tuner indicated generally at 88 includes a threaded rod 90. The rod 90 passes through the top wall 24 of the base 12 through a threaded opening (not depicted) in the top wall 24. Once the rod 90 has been positioned by rotating it with respect to the top wall 24, a nut 92 is tightened down on the top wall 24 to lock the rod 90 in place.

Inside the cavity 26, the rod 90 is located between the coupling loop 40 and the resonant element 28. A first plane can be formed perpendicular to the curved portion 46 of the coupling loop 40, and including the first arm 42. A second plane is also perpendicular to the curved portion 46 and includes the second arm 44. As best seen in FIG. 1, the rod 90 is between the first plane and second plane in the proximity of the curved portion 46. Also as seen in FIG. 1, an end 93 of the rod 90 is located between an inner edge 94 and an outer edge 96 of the resonant element 28. A third plane contains the major curve of the resonant element 28, and the rod 90 is essentially parallel to that third plane. Although the location of the rod 90 as shown in FIGS. 1–3 is preferred, the rod may be moved to other locations in the cavity while still being capable of adjusting the coupling between the coupling loop 40 and the resonant element 28.

Figure 6:
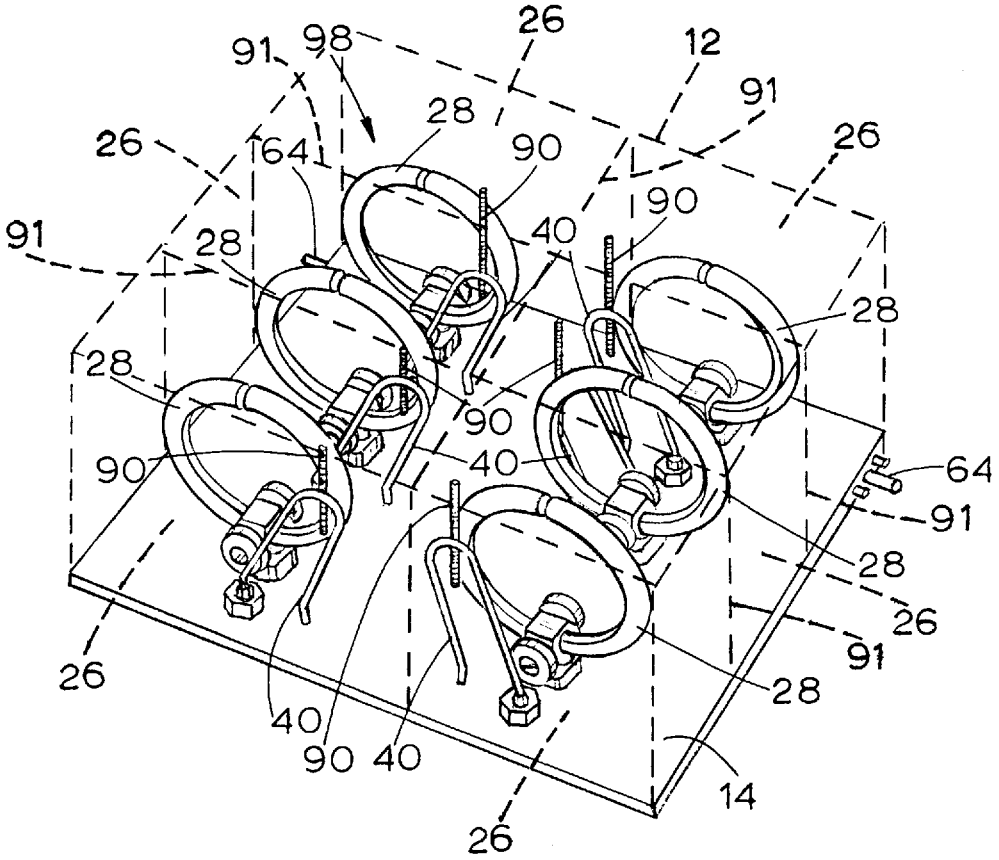
FIG. 6 is a perspective view of a filter lid having six resonators and six coupling loops with a base for the lid shown in phantom.

Referring now to FIG. 6, a cover 14 for a filter indicated generally at 98 is shown with six resonant elements 28, as well as six coupling loops 40. Ordinarily, several resonant structures will be combined together to form a bandstop or "notch" filter. In such a filter, the transmission line (not shown in FIG. 6) will be connected to each one of the coupling loops 40 and the input/output connections 64. A base 12 mates with the cover 14 and has several cavities 26 shown in FIG. 6. Tuning rods 90, are connected to the top wall of the base 12. The base 12 also has several interior side walls 91 to isolate each resonant element 28 and would also carry a resonance tuner for each resonant element 28. Each associated coupling loop 40 and resonant element 28 has a corresponding coupling rod 90 to adjust the coupling between the resonant structure containing the resonant element 28 and the coupling loop 40.

In order to set up a filter of the present invention, each resonant structure is first tuned to the proper resonant frequency by use of the resonance tuner 66. In the embodiment shown, the resonant element 28 is chosen so that its circumference is approximately equal to one-half the wave length of the desired resonance frequency, reduced by self-loading of the resonator at the gap, and are loaded by the resonance tuner. After tuning to the resonance frequency, the coupling bandwidth is adjusted using the coupling tuner 88. Each resonant structure in a filter is tuned similarly, however, the precise resonant frequency and coupling for each resonant structure in a filter may be different, as is known to those skilled in the art.

The housing for the resonant structure or filter should be constructed of a conductor such as copper or silver-plated aluminum or may be coated with a high-temperature superconductor. The resonator or resonant element 28 may also be made of a metal or coated with a high-temperature superconductor. If a superconductor coating is used, the method of U.S. Pat. No. 5,340,797, which is incorporated herein by reference, may be used for applying $YBa_2Cu_3O_7$respectively. The post 90 may be constructed of a metal such as copper, brass, or stainless steel, and may be coated with a low-loss material such as silver. The coupling loop 40 may be made of 12 A.W.G. copper wire. The pin 54 and transmission line 58 may also be made of copper. The peg 48 and nut 50 may be made of brass or other metal. The precise dimensions of any of the components will be dependent of the particular filtering characteristics which are desired. In addition, the distances between components, for instance between the resonant element 28, tuner post 90, and coupling loop 40, will also depend on the desired filtering characteristics.

If a filter or resonant element of the present invention is used with high-temperature superconductor materials, it will be necessary to cool the filter or resonant structure to extremely low temperatures. Under such conditions, it may be desirable to evacuate the cavity 26 to prevent any moisture in the cavity from freezing, and thereby damaging performance. If the cavity 26 is evacuated, vents (not depicted) may be placed in any passageway or opening which receives bolts or screws. For instance, vents may be placed from the outside of the base 12 or cover 14 to permit outgassing in any of the openings or passageways which receive bolts to hold the base 12 to the cover 14. The vents would connect the bottom of the openings with the environment outside the filter housing.

The filter or resonant structure may be placed in a bath of liquid nitrogen for cooling. In such instances, it may be desirable to pressurize the cavity 26 with a gas such as helium to minimize any leakage of liquid nitrogen into the cavity 26. The design of the filter or resonant structure of the present invention is particularly well suited for tuning when it is placed in a liquid nitrogen bath. Adjustments for the resonance tuner 66 and coupling tuner 88 are located outside of the housing. Moreover, the adjustment mechanisms for the resonance tuner 66 and coupling tuner 88 are located adjacent each other so that both tuning adjustments can be performed from the top of a liquid nitrogen bath without having to move or adjust the position of the filter or resonant structure.

The foregoing detailed description has been given for clearness of understanding only, and no unnecessary limitations should be understood therefrom, as modifications will be obvious to those skilled in the art.

We claim:

1. A resonant structure comprising:

a housing defining a cavity;

a resonant element located in the cavity;

a coupling loop coupled to a signal source, wherein the coupling loop is adjacent the resonant element; and a coupling tuner extending into the cavity between the resonant element and the coupling loop, wherein the coupling tuner includes means for adjusting an extent to which the tuner extends between the resonant element and the coupling loop.

2. The resonant structure of claim 1 wherein:

the housing comprises a base and a cover;

the resonant element and coupling loop are fixed to the cover; and the coupling tuner is attached to the base.

3. The resonant structure of claim 2 wherein:

the base includes four side walls and a top wall;

the four side walls are generally perpendicular to the cover;

the top wall is generally parallel to the cover; and the coupling tuner is attached to the top wall.

4. The resonant structure of claim 3 wherein the coupling tuner is adjusted from a location outside of the cavity adjacent the top wall.

5. The resonant structure of claim 4 further comprising a resonance tuner, wherein the resonance tuner is attached to the top wall and is adjusted from a location outside of the cavity.

6. The resonant structure of claim wherein the coupling tuner comprises a threaded rod passing through a wall of the housing and into the cavity.

7. The resonant structure of claim 1 wherein the coupling loop has a first end connected to the signal source through a transmission line and a second end connected to ground.

8. The resonant structure of claim 1 wherein:

the coupling loop sequentially comprises a first arm, a curved portion, and a second arm; and a first plane is perpendicular to a plane including the curved portion and the first plane includes the first arm;

a second plane is perpendicular to the plane including the curved portion and the second plane includes the second arm; and the coupling tuner extends between the first plane and the second plane in the proximity of the curved portion.

9. The resonant structure of claim 1 wherein:

the resonant element has a major curve located in a plane; and the coupling tuner extends generally parallel to the plane.

10. An electromagnetic filter comprising:

a housing defining a plurality of cavities;

a plurality of resonant elements wherein each resonant element is located in a respective cavity;

a plurality of coupling loops, wherein each coupling loop is coupled to a signal source and each coupling loop is adjacent a corresponding resonant element; and a plurality of coupling tuners for adjusting coupling between a respective coupling loop and a corresponding resonant element, each coupling tuner respectively, extending into a corresponding cavity wherein each coupling tuner includes respective means for adjusting an extent to which the tuner extends into the corresponding cavity.

11. The filter of claim 10 wherein each coupling tuner respectively comprises a threaded rod passing through a wall of the housing and into a corresponding cavity.

12. The filter of claim 10 wherein:

the housing comprises a base and a cover;

the resonant elements and coupling loops are fixed to the cover; and the coupling tuners are attached to the base.

13. The filter of claim 12 wherein:

the base includes four side walls and a top wall;

the four side walls are generally perpendicular to the cover;

the top wall is generally parallel to the cover; and each coupling tuner is attached to the top wall.

14. The filter of claim 13 wherein each coupling tuner respectively is adjusted from a location outside of the corresponding cavity adjacent the top wall.

15. The filter of claim 14 further comprising a plurality of resonance tuners, wherein each resonance tuner is attached to the top wall and is adjusted from a location outside of a corresponding cavity.

16. The filter of claim 10 wherein:

each coupling tuner respectively extends between a corresponding coupling loop and corresponding resonant element; and each coupling tuner includes respective means for adjusting the extent to which the coupling tuner respectively extends between the corresponding coupling loop and corresponding resonant element.

17. The filter of claim 16 wherein each coupling loop has a first end thereof connected to the signal source through a transmission line and a second end thereof connected to ground.

18. The filter of claim 16 wherein:

each coupling loop sequentially comprises a first arm, a curved portion, and a second arm;

a respective first plane is perpendicular to a plane including the corresponding curved portion and the first plane includes the respective first arm of a corresponding coupling loop;

a respective second plane is perpendicular to the plane including the corresponding curved portion and the second plane includes the respective second arm of the corresponding coupling loop; and a respective coupling tuner extends between the first plane and the second plane in the area of the corresponding curved portion.

19. The filter of claim 18 wherein:

each resonant element has a respective major curve located in a corresponding third plane; and each coupling tuner respectively extends generally parallel to the corresponding third plane.

* * * * *

UNITED STATES PATENT AND TRADEMARK OFFICE

CERTIFICATE OF CORRECTION

PATENT NO. : 5,847,627

DATED : December 8, 1998

INVENTOR(S) : Radzikowski et al.

It is certified that error appears in the above-identified patent and that said Letters Patent is hereby corrected as shown below:

In column 6, line 1 of Claim 6 (page 12, line 1 of claim 6 in specification), insert --1— after the word "Claim".

Signed and Sealed this

Twenty-fifth Day of May, 1999

*Attest:*

Q. TODD DICKINSON

*Attesting Officer*

*Acting Commissioner of Patents and Trademarks*